US009670051B1

(12) United States Patent
Onda

(10) Patent No.: US 9,670,051 B1
(45) Date of Patent: Jun. 6, 2017

(54) FOLDAWAY CONTAINER DRAINER

(71) Applicant: George Onda, Loveland, CO (US)

(72) Inventor: George Onda, Loveland, CO (US)

(73) Assignee: George Onda, Loveland, CO (US)

( * ) Notice: Subject to any disclaimer, the term of this patent is extended or adjusted under 35 U.S.C. 154(b) by 0 days.

(21) Appl. No.: 14/886,079

(22) Filed: Oct. 18, 2015

(51) Int. Cl.

| | |
|---|---|
| ***B67D 3/00*** | (2006.01) |
| ***A47B 73/00*** | (2006.01) |
| ***A47G 23/02*** | (2006.01) |
| ***B67C 9/00*** | (2006.01) |
| ***A47F 7/28*** | (2006.01) |

(52) U.S. Cl.
CPC ..... *B67D 3/0083* (2013.01); *A47B 73/00* (2013.01); *A47F 7/28* (2013.01); *A47G 23/0241* (2013.01); *B67C 9/00* (2013.01)

(58) Field of Classification Search
CPC ..... A47B 73/00; A47B 73/002; A47B 73/004; A47B 73/006; A47B 73/008; B08B 9/423; A47G 23/0241; A47G 23/02; A47G 23/0208; A47G 23/0216; A47G 23/0266; B67C 9/00; A47F 7/28; A47J 47/16; A47J 47/20; B67D 3/0083
See application file for complete search history.

(56) References Cited

U.S. PATENT DOCUMENTS

| | | | | |
|---|---|---|---|---|
| 2,942,828 A * | 6/1960 | Kondrat | A47G 23/0258 | 248/145.6 |
| 2,991,907 A * | 7/1961 | Kinnison | A47G 23/0216 | 16/425 |
| 3,233,858 A * | 2/1966 | Benjamin | B60N 3/102 | 248/311.2 |
| 3,615,150 A | 10/1971 | Indrunas | | |
| 3,814,293 A | 6/1974 | Daves | | |
| 4,271,878 A | 6/1981 | Bologa | | |
| 4,454,897 A | 6/1984 | Valiant | | |
| 4,557,452 A * | 12/1985 | Khuong | A47G 23/0225 | 248/214 |
| 4,723,671 A | 2/1988 | Mears | | |
| D307,225 S | 4/1990 | Freidenfelds | | |
| 5,002,246 A | 3/1991 | Chaffin | | |
| 5,071,002 A | 12/1991 | Bradley | | |
| 5,080,150 A | 1/1992 | Deadwyler, Jr. | | |
| 5,105,860 A | 4/1992 | Connor | | |
| D343,767 S | 2/1994 | Sambrookes | | |
| 5,297,600 A | 3/1994 | Downes | | |
| 5,435,513 A | 7/1995 | Davis | | |
| 5,439,193 A | 8/1995 | Coulter et al. | | |

(Continued)

*Primary Examiner* — Daniel J Colilla

(57) ABSTRACT

A draining device for the primary purpose of completely draining unused contents that frequently remain trapped inside various containers due to an inadequate way to sufficiently remove them. This draining device comprises an upper enclosure, a base abutment and a support bracket with a first end and a second end that is attached to the upper enclosure and the base abutment. When the upper enclosure and base abutment are in an opened, perpendicular position to their adjoining support bracket, an inverted container is placed through the upper enclosure and lowered until the lid extends through, or it rests upon the base abutment. Thus, the remaining contents are collected at the inverted container's cap or lowermost section for additional usage until the remaining contents are completely utilized and the container is thoroughly depleted.

18 Claims, 9 Drawing Sheets

(56) References Cited

U.S. PATENT DOCUMENTS

| | | | | |
|---|---|---|---|---|
| 5,460,298 | A | 10/1995 | Dibiase | |
| 5,540,264 | A | 7/1996 | Harp | |
| 5,634,573 | A | 6/1997 | Steinberg | |
| 5,655,673 | A * | 8/1997 | Weterrings | A47F 7/283 211/74 |
| 5,664,753 | A | 9/1997 | Takei | |
| 5,769,280 | A | 6/1998 | Ehresmann | |
| 5,794,904 | A | 8/1998 | Hackley | |
| D426,428 | S | 6/2000 | Fredenberg | |
| 6,095,374 | A | 8/2000 | Ricard et al. | |
| 6,109,581 | A | 8/2000 | Kracke | |
| D435,711 | S | 12/2000 | Weiser | |
| D448,978 | S | 10/2001 | Isbell | |
| 6,345,723 | B1 | 2/2002 | Blake | |
| RE37,566 | E | 3/2002 | Cristea | |
| 6,682,028 | B1 | 1/2004 | Hackal | |
| 6,684,922 | B1 | 2/2004 | Alston | |
| D515,877 | S | 2/2006 | Czepowicz et al. | |
| D515,878 | S | 2/2006 | Czepowicz et al. | |
| 7,090,087 | B1 | 8/2006 | Guralski | |
| 7,261,221 | B2 | 8/2007 | Awbrey et al. | |
| 7,415,996 | B2 * | 8/2008 | Favreau | A47G 23/0241 141/364 |
| 7,490,798 | B2 | 2/2009 | Mann | |
| 8,690,018 | B2 | 4/2014 | van der Heijden et al. | |
| 2012/0305598 | A1 | 12/2012 | Costello | |
| 2013/0026118 | A1 * | 1/2013 | De Lourdes Mireles | A47G 23/0241 211/74 |

* cited by examiner

FOLDAWAY CONTAINER DRAINER

BACKGROUND OF THE EMBODIMENT

The present embodiment addresses the current problem of completely draining the remaining, useable contents that are commonly trapped inside of many containers and very difficult to extract. Although some interesting and clever attempts have been made to solve the ongoing problem of utilizing the entire contents, I have found that most prior art references require using a device on flat surfaces and providing enough room for actual use and proper storage. While additional counter or refrigerator space is needed many times to accomplish necessary day to day tasks, taking up needed space to drain a container could potentially create the problem of having less space for more important uses. For example, see U.S. Pat. No. 20120305598 A1 by Costello (December 2012). While this drainer requires continuous expansion and contraction motions, the structure of this device will become weakened and become less reliable. It also requires necessary counter or refrigerator space to use, and it can only accommodate limited containers. This device also requires the necessary space above to accommodate various sizes of containers. Storage can create an additional problem with its wide base. U.S. Pat. No. 7,490,798 B2 by Mann (February 2009) is another clever attempt at a collapsible draining device. But, this device also requires sufficient counter space to use and can only be used on a flat surface. Because this device is constructed with many metal rods, it can be difficult to assemble and clean, and will rust over time. Although a flat area is often required to use a draining device, another problem I have discovered is the ease in which a container can tip over due to an accidental bump because of an insufficient base. For example, see U.S. Pat. No. 6,109,581 A by Kracke et al (August 2000), 20020066844 A1 by Kelly (June 2002), U.S. Pat. No. 7,090,087 B1 by Guralski (August 2006), U.S. Pat. No. 5,794,904 A by Hackley (August 2098), U.S. Pat. No. 6,684,922 B1 by Alston et al (February 2004), U.S. Pat. No. 5,794,671 A by Smith (August 2098), and 20130026118 A1 by Mireles (January 2013).

Although various forms of container draining devices exist, there still remains a need for a draining device that does not interfere with counter or refrigerator space, can be stored or folded up easily out of the way, and requires minimal materials to produce.

SUMMARY

Advantages

Although several examples have been cited of prior art deficiencies, these were necessary to explain why the present embodiment can be a more effective, unobtrusive, and economical approach to solving the noted flaws. Accordingly, several advantages of one or more aspects are as follows:

a. to provide a container draining device that requires a minimal amount of materials and can be easily manufactured.
b. is less expensive to produce and can be sold for less than other competitive products.
c. can drain various containers without removing them when the device is attached to a wall.
d. can accommodate containers of various shapes and sizes.

e. can easily attach to a wall and can easily be removed and placed in a different location.
d. requires no tools or hardware for assembly, operation, and wall or cabinet mounting.
e. can be folded up to a compact, space-saving position when not in use.
f. can be wall mounted for convenient accessibility and storage.
g. can be used in wet locations as well (e.g. shower, bathtub, outdoors, etc.).
h. can be used as a bar soap holder that effectively aids in the removal of water.
i. can be used as a beverage holder inside of various lockers, storage units, cubicles, etc. to prevent spills on important work, electronic devices, keyboards, supplies, tools, etc.
j. can be used in the home, garage, office, school, recreational vehicles, outdoors, etc.

These and other advantages of one or more aspects will become apparent from a consideration of the ensuing description and accompanying drawings.

The stated embodiment above solves the ongoing problem of thoroughly draining a container of its remaining contents frequently trapped inside. This is accomplished by inverting a container and placing it through an upper enclosure and resting the cap or lid on the base abutment. The remaining contents subsequently collect at the lowest section of the inverted container ready to be used. This can also be accomplished by inserting the container dispensing cap through an opening in the base abutment and dispensing the contents while still in the inverted position.

An additional embodiment allows a container to be pushed through the front section of the upper enclosure and subsequently placed onto the base abutment for thorough draining. This feature allows for an additional, convenient container entry point for placement and depletion of what remains inside.

Therefore, the remaining contents will collect at the bottom or cap section where they will then be dispensed as needed until the container is completely depleted.

DETAILED DESCRIPTION

FIGS. 1,2,3,4,5,6,7,8

First Embodiment

Figure 1:
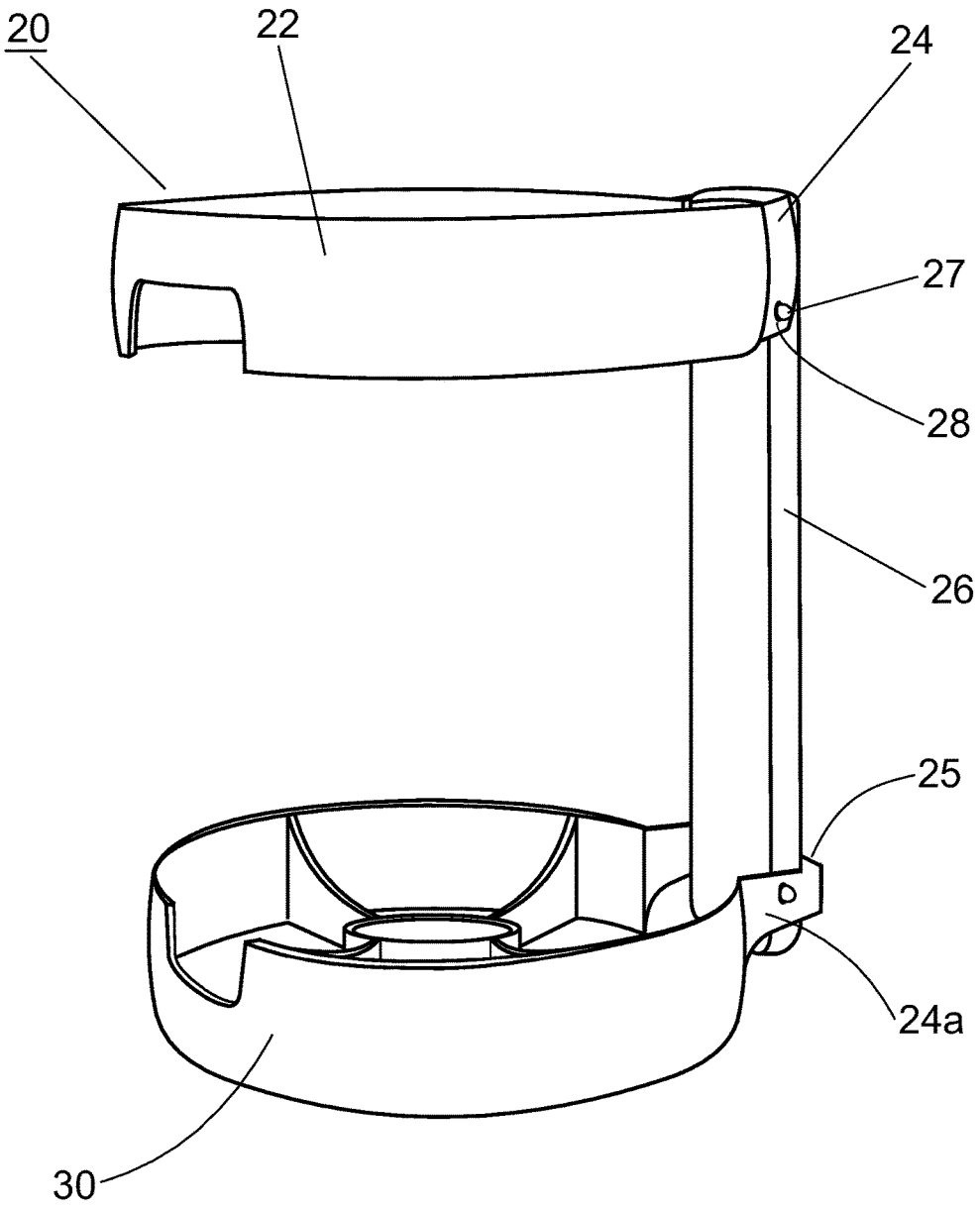
FIG. 1 is a perspective view of a first embodiment in its fully extended mode.

FIG. 1 is a perspective view taken from a user's corner side of The Foldaway Container Drainer 20 constructed in accordance with one embodiment. The upper section of the draining device has an upper enclosure 22 with an opening on the rear portion of the enclosure. Attached to each edge of the opening is a joint 24 that extends outward and connects to an upper end of a support bracket 26 with a side post 27 and joint eyelet 28 on each side. The support bracket 26 is enclosed on all sides except the backside that has a predetermined open cavity. A base abutment 30 also has an opening on the rear portion with an outward extending joint 24*a* attached at a predetermined position of the opening. Connected to the outermost edge of each lower joint 24*a* is a perpendicular arm 25 that wraps behind the support bracket 26 to serve as a holding mechanism for the base abutment 30 when in the opened position. The base abutment joints 24*a* are connected to the bottom end of the support bracket 26 with a side post 27 and a joint eyelet 28 on each side.

Figure 2:
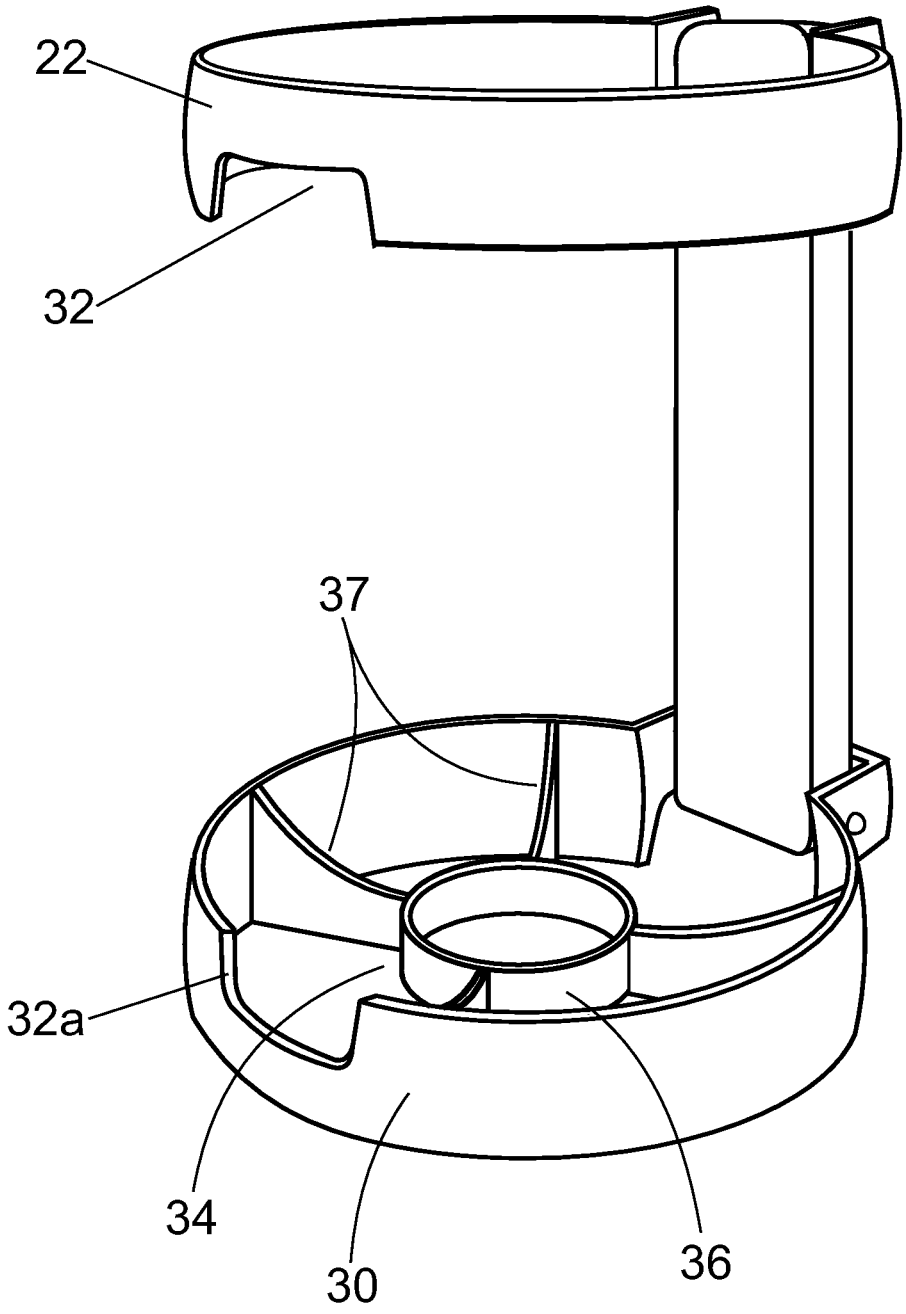
FIG. 2 is an upper angle view of the first embodiment showing a wider view of the base abutment.

FIG. 2 is a left corner perspective view of the draining device 20 showing a notch 32 in the front section of the upper enclosure 22 and the front section of the base abutment 32*a* sized to fit over the support bracket 26 when in the closed position. The base abutment 30 shows an upper view of the inner abutment 34 with a convenient central opening 36 to allow various container cap sizes to be lowered through for more accessible dispensing without the need to remove the container from the device. The central opening is held in place by a plurality of structural supports 37 to support a container in the central opening of the base abutment 30.

Figure 3:
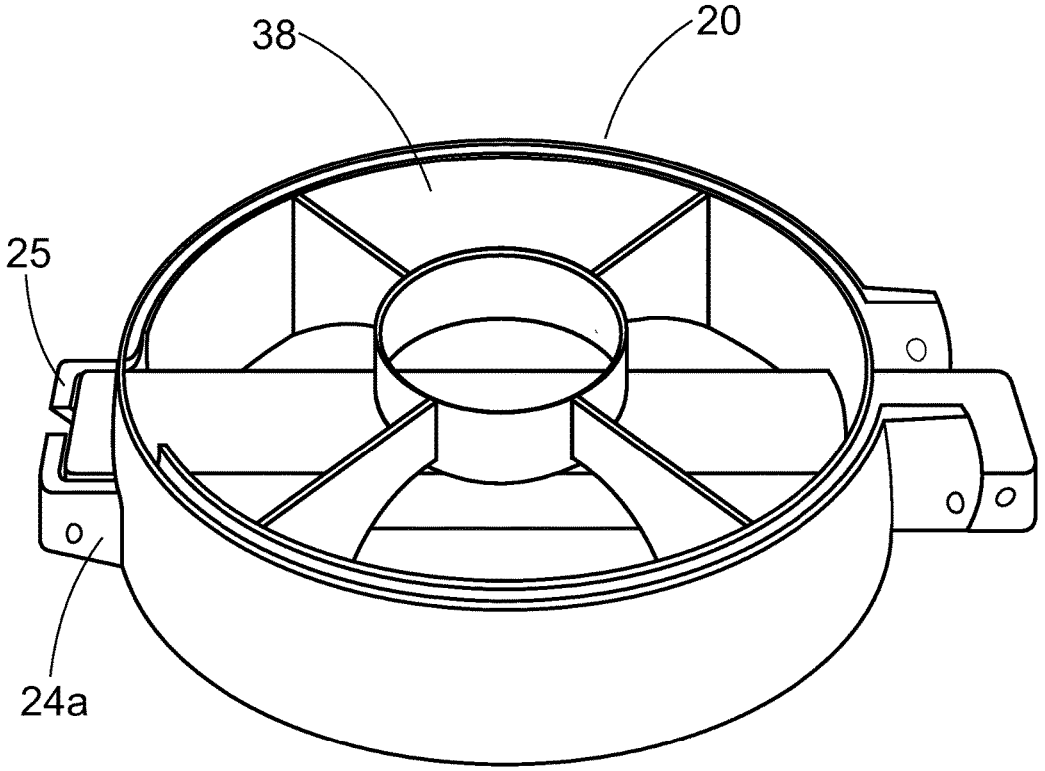
FIG. 3 is a perspective view of the disclosed device in its foldaway position to enable convenient storage.

FIG. 3 shows the device 20 in a closed, compact position 38 to allow for space-saving purposes.

Figure 4:
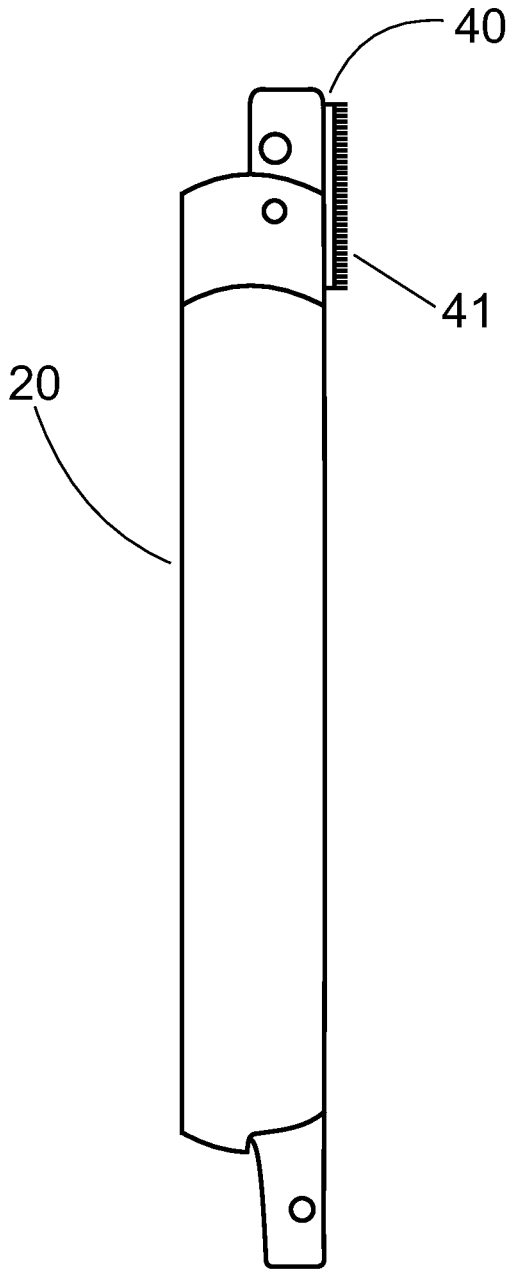
FIG. 4 is a side view of the disclosed device in its fully compact position to illustrate its space-saving feature, and to illustrate its slim wall mount connector.

FIG. 4 shows the space-saving side view of the device 20 when in a closed position with a mounting pad 40.

Figure 5:
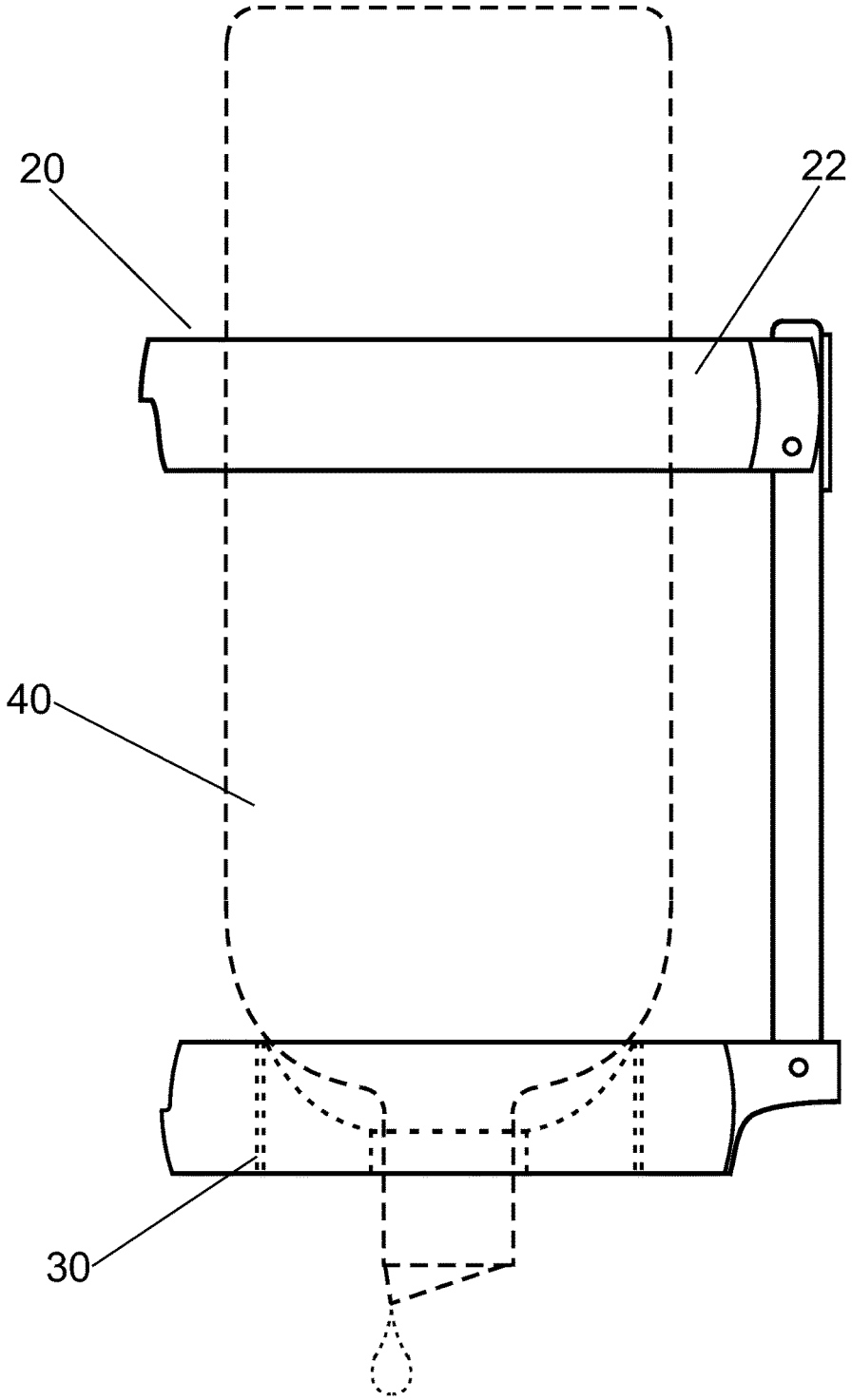
FIG. 5 is a side view of the disclosed device in its fully extended mode with a phantom inverted container placed inside to illustrate the method of using the draining device.

FIG. 5 shows a side view of The Foldaway Container Drainer with an inverted phantom container placed inside to illustrate the operation of the device 20.

Figure 6:
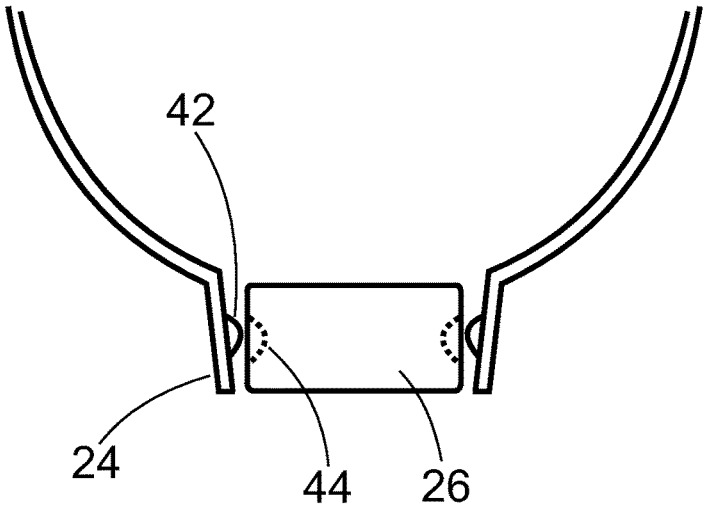
FIG. 6 is a top view of an upper enclosure anchoring mechanism when the upper enclosure is in its open, horizontal position in accordance with the first embodiment.

FIG. 6 shows a top view of the upper enclosure joints 24 with an anchoring mechanism 42 on the inside of each upper joint. The anchoring mechanism 42 fits inside of a pocket 44 on each side of the support bracket 26 to secure the upper enclosure 22 in an open position.

Figure 6A:
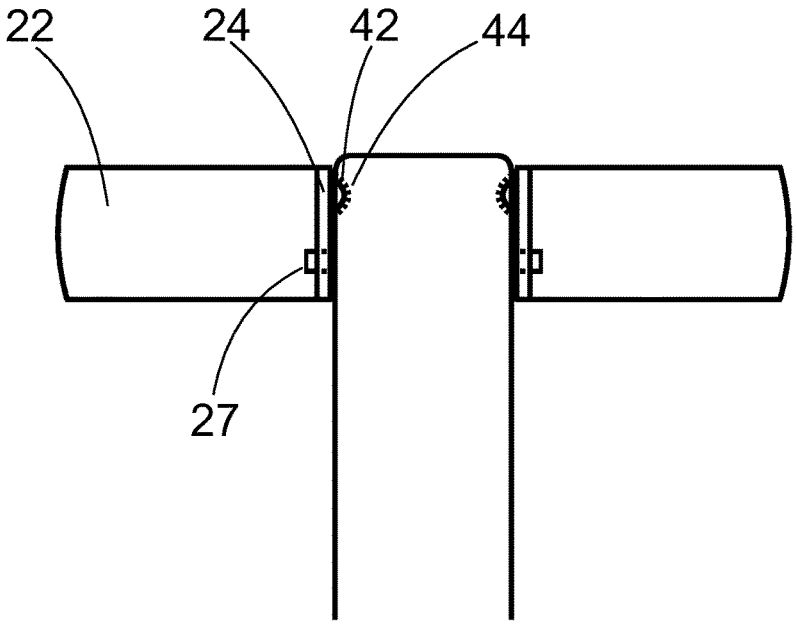
FIG. 6A is a rear view of the support bracket and upper enclosure when secured in place with the anchoring mechanism in accordance with the first embodiment.

FIG. 6A shows a rear view of the upper enclosure 22 secured in an open position with the anchoring mechanism 42 fixed inside of the pocket 44. The rear view also shows the upper support bracket posts 27 securing the upper enclosure joints 24.

Figure 7:
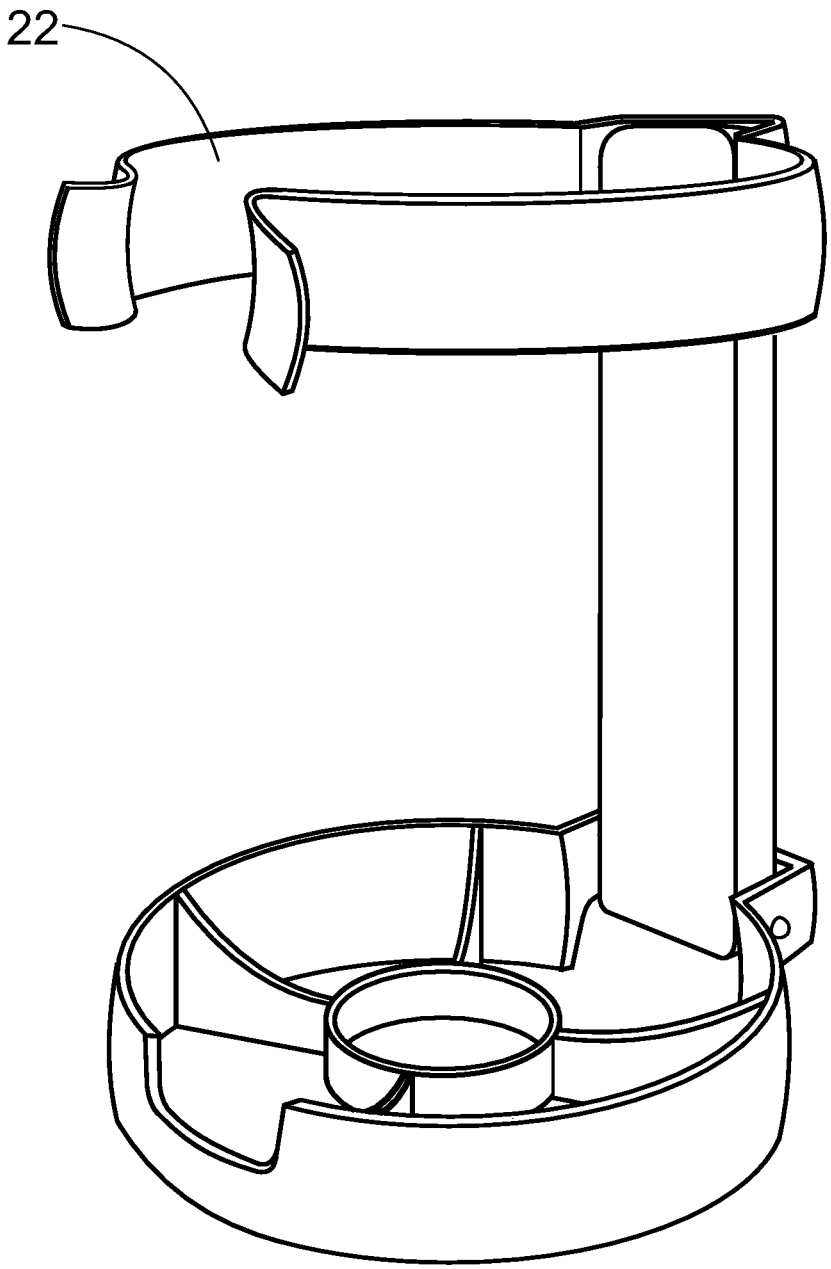
FIG. 7 is a perspective view of a second embodiment showing the front of the upper enclosure opened and flared out diagonally to allow inverted containers, beverages, etc. to be pushed through the enclosure then lowered onto the base abutment.

FIG. 7 is an upper perspective view of a second embodiment showing an opening in the frontal section of the upper enclosure 22 with each end of the opening 46 being flared outward diagonally.

Figure 7A:
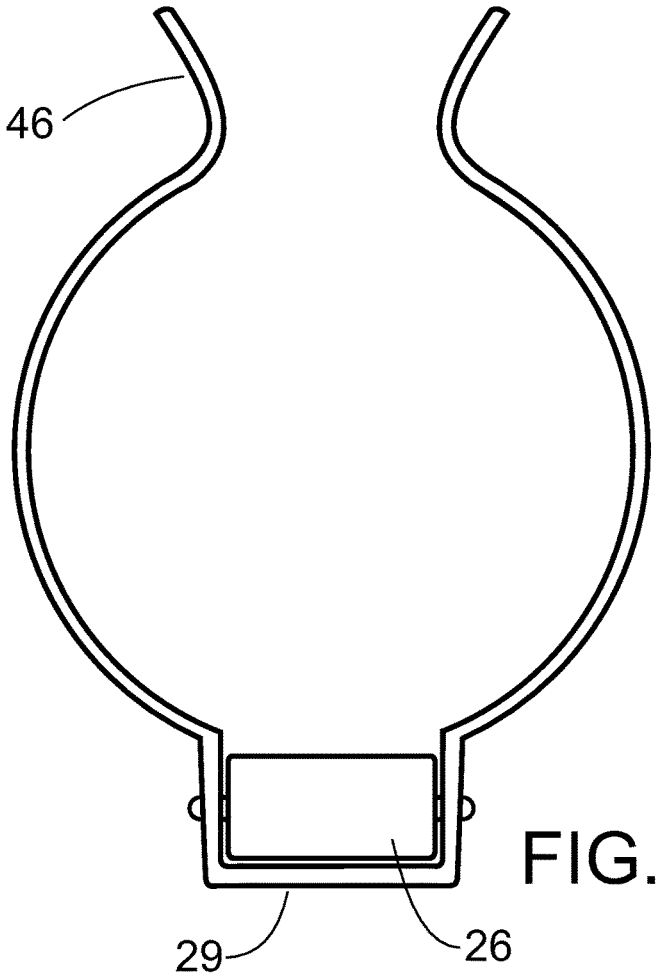
FIG. 7A is a top view of the second embodiment upper enclosure with each front opened end flaring out diagonally. The top view also shows the upper enclosure pivoting joints connected together behind the support bracket.

FIG. 7A is a top view of the upper enclosure showing the opened diagonal ends 46 more clearly, and the upper enclosure joints 29 attached to each side of the support bracket 26 in accordance with the second embodiment.

Figure 7B:
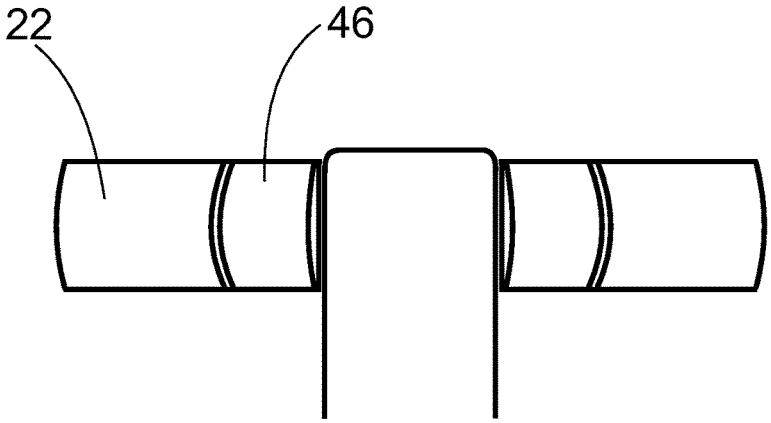
FIG. 7B is a front view of the second embodiment upper enclosure when it is in the opened position.

FIG. 7B is a front view of the upper enclosure 22 in accordance with the second embodiment.

Figure 8:
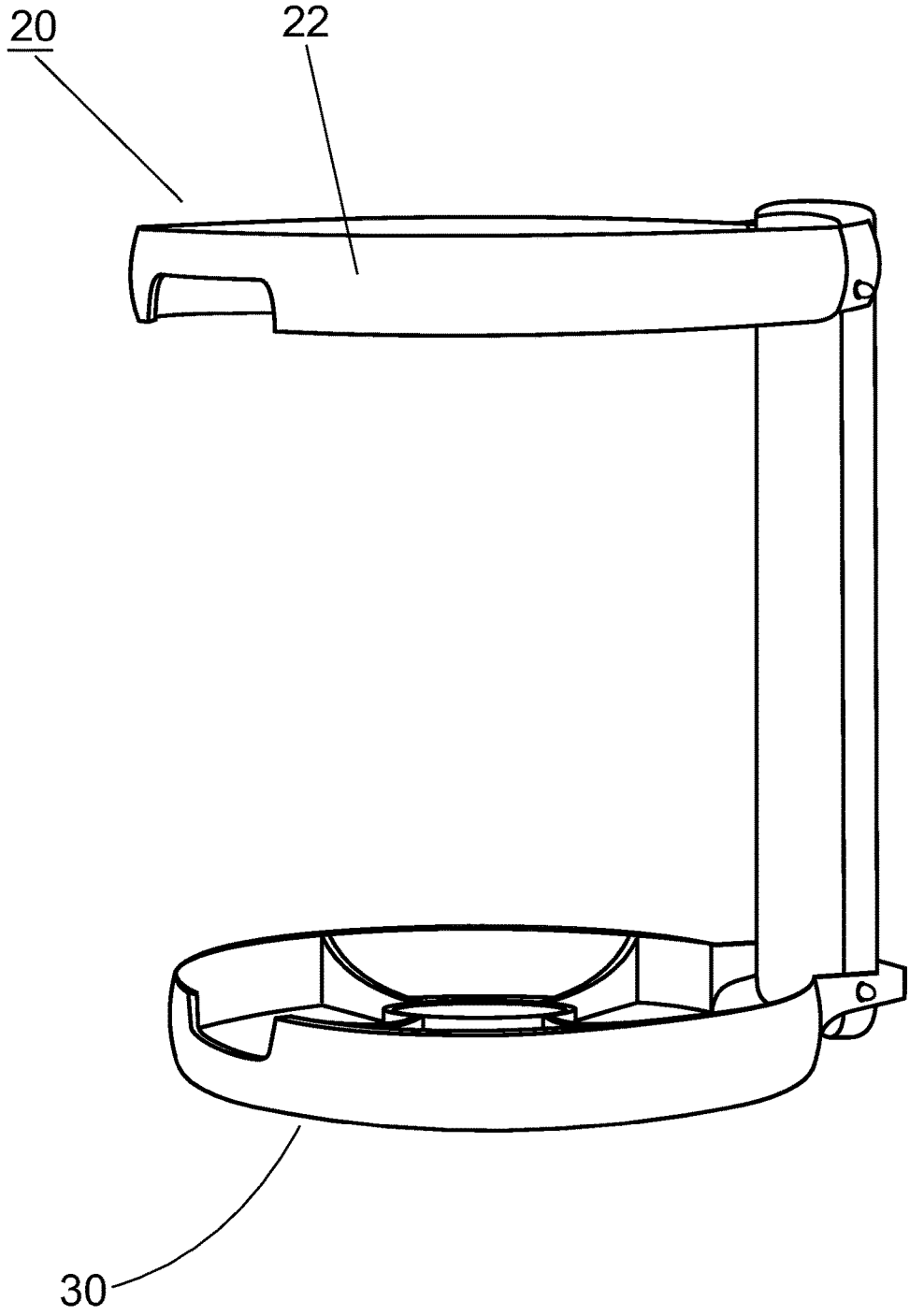
FIG. 8 is an upper front corner view of a third embodiment showing the upper enclosure and base abutment having a narrower width than the first and second embodiments.

FIG. 8 is an upper front corner view of a third embodiment showing a narrow upper enclosure 22 and a narrow base abutment 30 attached to said support bracket.

Operation

In operation, one first opens the upper enclosure 22 to its horizontal position by connecting each anchor mechanism 42 into each anchor pocket 44 located just above the support bracket side posts. One then opens the base abutment 30 to its horizontal position until it stops. One subsequently places an inverted container through the upper enclosure 22 and lowers the cap or lid onto the base abutment 30. One leaves the inverted container inside the draining device 20 for several minutes or longer to completely collect the existing contents trapped inside. Once the contents are collected at the bottom, one simply dispenses the desired amount while still inside, or removes the container while keeping it inverted and dispensing the desired amount. After closing the cap, one returns the container in the inverted position back to the draining device 20 for later use. Once the container has been completely depleted, the container is now ready to be recycled or disposed of. Because the draining device 20 is self-contained, no tools or fastening hardware is needed to assemble or use this device. This device can also be mounted to a wall, inside of a pantry or refrigerator, inside of various cabinet doors, etc., unlike other known draining devices that require a flat surface to use. And, it does not require any tools, screws, nails, etc. to mount. The device has many uses inside and outside the home that will save consumers countless dollars on various foods, bath products, automotive products, household products, etc. When the device is not in use, simply fold it up out of the way or simply disconnect it from the wall mount and store it away. The many uses include, but are not limited to:

1. Thoroughly draining shampoos, conditioners, various other bathroom products, etc., and therefore utilizing all remaining, usable contents of the product.
2. Completely emptying various foods inside the pantry and refrigerator such as syrups, salad dressings, cooking oils, ketchup, sauces, various condiments, etc.
3. It can be used inside campers and trailers as well for similar purposes as mentioned above. The device effectively drains the entire contents of camping supplies avoiding untimely visits back to grocery or supply stores.
4. The device is also used as a soap dish inside the shower or bathtub. It quickly and effectively aids in removing water off of soap thereby extending its use.
5. The device can additionally be used for students or professionals as a drink holder inside of lockers, storage units, cubicles, etc. to avoid spilling beverages on important work, reading materials, electronic devices, homework, tools, etc.
6. This device can be hung on many different surfaces without any tools, screws, nails, glue, etc., preventing any damage from occurring.

7. The device can be valuable in the garage as well to thoroughly empty various automotive and outdoor products (e.g. motor oil).

CONCLUSIONS, RAMIFICATIONS AND SCOPE

Thus, the reader will see that at least one embodiment of the device provides a more reliable, effective, and economical way to completely utilize the entire remaining contents of various products inside and outside the home. The device provides a unique method for maximal product removal while saving consumers countless dollars by utilizing a product's remaining, usable contents.

Although the description above contains many specifics, these should not be construed as limiting the scope of the embodiments, but as merely providing illustrations of some of several embodiments. For example, the upper enclosure and the base abutment can have other shapes such as square, oval, triangular, trapezoidal, rectangular, asymmetrical, etc.; the base abutment central opening can be larger or smaller, oval, square, triangular, rectangular, etc.; the upper enclosure, the base abutment, and support bracket can be larger or smaller to accommodate larger or smaller containers, etc.; the upper enclosure and base abutment can have various widths, designs, etc.; the color of the entire device or its individual parts can be one solid color, different colors, transparent colors, clear, decorative textures and/or designs, etc.; the height of the device can be longer or shorter, etc.; the joints can be attached with screws and nuts made with metal, plastic, nylon, etc. Thus, the scope of the embodiments should be determined by the appended claims and their legal equivalents, rather than by the examples given.

U.S. PATENT CITATIONS

| Cited Patent | Filing Date | Publication Date | Applicant | Title |
|---|---|---|---|---|
| 3,615,150A | 1961 Oct. 31 | 1971 Oct. 26 | Indrunas William G | Means for draining catsup bottles |
| 3,814,293A | 1973 Jan. 31 | 1974 Jun. 4 | J Daves | Bottle securing and dispensing apparatus |
| 4,271,878A | 1977 Oct. 31 | 1981 Jun. 9 | Elvis Bologa | Liquid transfer device |
| 4,454,897A | 1982 Sep. 27 | 1984 Jun. 19 | Dimitri Valiant | Ketchup bottle support |
| 4,723,671A | 1986 Oct. 1 | 1988 Feb. 9 | Mears Gary L | Bottle cap stand |
| D307,225S | 1988 Jun. 22 | 1990 Apr. 17 | Freidenfelds Jason | Inverted bottle holder |
| 5,071,002 | 1989 Jul. 24 | 1991 Dec. 10 | Bradley Donald S | Invertable holder for containers |
| 5,002,246A | 1990 Apr. 30 | 1991 Mar. 26 | Chaffin Mary G | Container drain support |
| 5,105,860A | 1990 Nov. 30 | 1992 Apr. 21 | Connor Annette B | Apparatus for draining fluid containers |
| 5,080,150A | 1991 Apr. 22 | 1992 Jan. 14 | Deadwyler Jr Hugh A | Condiment bottle draining basket |
| 5,460,298 | 1992 Dec. 28 | 1995 Oct. 24 | Dibiase Anthony E | Stand for container inversion |
| 5,439,193A | 1992 Oct. 28 | 1995 Aug. 8 | Xcel Industrial Group | Container inverting support |
| D343,767 | 1992 Aug. 10 | 1994 Feb. 1 | Sambrookes Samuel R Sheryl R | Bottle drainer |
| 5,297,600 | 1993 Jan. 13 | 1994 Mar. 29 | Downes Kenneth V | Container emptying device |
| 5,435,513A | 1994 Apr. 13 | 1995 Jul. 25 | Davis Robert T | Apparatus for suspending containers in an inverted position |
| 5,794,904 | 1995 Nov. 28 | 1998 Aug. 18 | Hackley Carl L | Holder for inverted bottles |
| 5,634,573A | 1995 Jul. 31 | 1997 Jun. 3 | Steinberg Joel | Dispensing system and method for viscous materials |
| 5,540,264A | 1995 Mar. 23 | 1996 Jul. 30 | Harp Timmy R | Container drain support and fluid collection apparatus |
| 5,664,753A | 1995 Jul. 14 | 1997 Sep. 9 | Takei Koji | Bottle or container holder for holding the bottle or container in an inverted position |
| 5,769,280A | 1997 Jan. 16 | 1998 Jun. 23 | Ehresmann Ervin | Inverted bottle holder and stand |
| RE37,566E1 | 1998 Jul. 31 | 2002 Mar. 5 | Cristea Denise M | Holding device for collecting residual contents in a container |
| 6,109,581 | 1998 May 22 | 2000 Aug. 29 | Kracke David R | Inverted container holder |
| 6,095,374A | 1999 Mar. 15 | 2000 Aug. 1 | Good Idea! Inc. | Closure for supporting a container of viscous liquid |
| 6,345,723 | 2000 May 31 | 2002 Feb. 12 | Blake Vance G | Upright and inverted bottle and container holder for contents availability |
| D435,711S | 2000 Apr. 13 | 2000 Dec. 26 | Weiser Susie H Haddad Richard A | Bottle draining stand |
| D448,978s1 | 2000 Sep. 19 | 2001 Oct. 9 | Isbell John Paul | Bottle cradle |
| D426,428 | 1999 Sep. 13 | 2000 Jun. 13 | Fredenberg Kathy L | Support for an inverted bottle |

-continued

U.S. PATENT CITATIONS

| Cited Patent | Filing Date | Publication Date | Applicant | Title |
|---|---|---|---|---|
| 6,684,922 | 2002 Aug. 1 | 2004 Feb. 3 | Alston Shirley M | Container drainer holder |
| 7,090,087 | 2003 Jun. 12 | 2006 Aug. 15 | Guralski Daniel M | Apparatus for holding an inverted container |
| 6,682,028B1 | 2003 Feb. 25 | 2004 Jan. 27 | Hackal Mike | Apparatus for holding container in inverted configuration |
| 7,261,221B2 | 2003 Apr. 16 | 2007 Aug. 28 | Innovation And Design, Inc. | Inverted dispensing system and apparatus |
| D515,877 | 2004 Nov. 22 | 2006 Feb. 28 | Protonium, Inc. | Holder for an inverted container |
| D515,878 | 2005 Jun. 23 | 2006 Feb. 28 | Protonium, Inc. | Holder for an inverted container |
| 7,490,798B2 | 2006 Jun. 22 | 2009 Feb. 17 | Mann David A | Apparatus for supporting a container |
| 8,690,018B2 | 2009 May 6 | 2014 Apr. 8 | Diversey, Inc. | Wall mountable dispenser and method of dispensing material |
| 20120305598 | 2012 May 29 | 2012 Dec. 6 | Costello Colleen L | Device and method for draining contents from containers |

I claim:

1. A draining device for supporting a container with contents in an inverted position comprising:

an upper enclosure with an opening through which a bottom portion of said container extends and is removably retained, a support bracket having a first end and a second end, said bracket connected at said first end to said upper enclosure, said upper enclosure having an opened position supporting said container and a closed position, said upper enclosure containing a frontal slot sized to fit over said support bracket when in the closed position, wherein said upper enclosure is substantially parallel to said support bracket, a base abutment upon which a container rests and is removably supported with an opening that allows a top portion of said container to extend through said base abutment, said base abutment having an opened position supporting said container and a closed position, wherein said base abutment is substantially parallel to said support bracket, and said base abutment is nested in said upper enclosure, whereby said contents are drained through an opening in the top portion of said inverted container when said upper enclosure and said base abutment are in said open position.

2. The draining device of claim 1 wherein said device comprising slightly rigid material comprising various colors, designs, shapes, sizes, and textures.

3. The draining device of claim 1 wherein said upper enclosure is slightly wider than said base abutment, thus when folded over together upon the support bracket in the closed position, a large area behind the draining device can be seen through the draining device.

4. The draining device of claim 1 wherein said upper enclosure contains pivoting joints in a predetermined position for connecting to said support bracket and folding over said base abutment when in the closed position, thus forming a compact, space-saving device.

5. The draining device of claim 4 wherein said upper enclosure pivoting joints contain an anchoring mechanism protruding from said pivoting joints for securing said upper enclosure in an opened position.

6. The draining device of claim 1 wherein said upper enclosure contains a frontal slot sized to fit over said support bracket when in the closed position.

7. The draining device of claim 1 wherein said device is comprised of various colors, designs, shapes, sizes, and/or textures.

8. The draining device of claim 1 wherein said support bracket contains a small post protruding from each side of the first end and second end of said support bracket.

9. The draining device of claim 8 wherein the first end of said support bracket contains a small pocket on each side at a predetermined location near said post.

10. The draining device of claim 9 wherein said support bracket is enclosed on all sides except the backside that has a predetermined open cavity.

11. The draining device of claim 9 wherein said support bracket contains a mounting pad on the backside at a predetermined location.

12. The draining device of claim 1 wherein said base abutment contains a frontal slot sized to fit over said support bracket when in the closed position.

13. The draining device in claim 1 wherein said base abutment having attaching joints for connecting to said support bracket at a predetermined location.

14. The draining device in claim 13 wherein said base abutment attaching joints contain a means for pivoting.

15. The draining device in claim 1 wherein said base abutment comprising a central opening supported by a plurality of structural supports.

16. The draining device in claim 15 wherein said base abutment comprising a plurality of structural supports with upper concaved edges.

17. A draining device for supporting a container with contents in an inverted position comprising:

an upper enclosure with a predetermined frontal opening through which said container passes through in a horizontal direction and through which a bottom portion of said container extends through said enclosure and is removably contained, a support bracket having a first end and a second end, said bracket connected at said first end to said upper enclosure, said upper enclosure having an opened position supporting said container and a closed position, said upper enclosure frontal opening opening ends sized to fit on each side of said support bracket when in the closed position, when said upper enclosure is substantially parallel to said support bracket, a base abutment with an opening through which a top portion of said container extends through and rests upon and is removably supported, said base abutment having an opened position supporting said container and a closed position, said base abutment containing a frontal slot sized to fit over said support bracket when in the closed position, wherein said base abutment is substantially parallel to said support bracket and said base abutment is nested in said upper enclosure, whereby said contents are drained through an opening in the top portion of said inverted container when said upper enclosure and said base abutment are in said open position.

18. A draining device for supporting a container with contents in an inverted position comprising:

a slim upper enclosure with an opening through which a bottom portion of said container extends and is removably retained, a slim support bracket having a first end and a second end, said slim support bracket connected at said first end to said slim upper enclosure, said slim upper enclosure having an opened position supporting said container and a closed position, said slim upper enclosure containing a frontal slot sized to fit over said slim support bracket when in the closed position, wherein said slim upper enclosure is substantially parallel to said slim support bracket, a slim base abutment with an opening through which a top portion of said container extends through and rests upon and is removably supported, said slim base abutment having an opened position supporting said container and a closed position, said slim base abutment containing a frontal slot sized to fit over said slim support bracket when in the closed position wherein said slim base abutment is substantially parallel to said slim support bracket and said slim base abutment is nested in said slim upper enclosure, whereby said contents are drained through an opening in the top portion of said inverted container when said slim upper enclosure and said slim base abutment are in said open position.

* * * * *